United States Patent [19]

Lew et al.

[11] Patent Number: 4,547,929

[45] Date of Patent: Oct. 22, 1985

[54] SPRING BIASED SHIFTING PIVOTING CENTER HINGE

[76] Inventors: Hyok S. Lew, 7890 Oak St., Arvada, Colo. 80005; Michael Stranahan, P.O. Box 15, Woody Creek, Colo. 81656

[21] Appl. No.: 575,587

[22] Filed: Jan. 31, 1984

[51] Int. Cl.[4] ..... E05F 1/08

[52] U.S. Cl. ..... 16/286; 16/361

[58] Field of Search ..... 16/286, 291, 293, 296, 16/360, 361, 357

[56] References Cited

U.S. PATENT DOCUMENTS

| | | | |
|---|---|---|---|
| 130,472 | 8/1872 | Brinser | 16/361 |
| 2,653,036 | 9/1953 | Creel et al. | 16/361 X |
| 3,549,246 | 12/1967 | Ruesch | 16/286 X |

FOREIGN PATENT DOCUMENTS

| | | | |
|---|---|---|---|
| 1159540 | 6/1958 | France | 16/357 |
| 1204321 | 1/1960 | France | 16/361 |
| 8428 | of 1901 | United Kingdom | 16/286 |

*Primary Examiner*—Fred Silverberg

[57] ABSTRACT

This invention relates to a spring biased shifting pivoting center hinge for swinging doors wherein the hinge pin rigidly affixed to the first swinging half of the hinge pivotably and shiftably engages a slotted hole with a spring bias that is included in the second swinging half of the hinge. The spring bias resiliently retains the hinge pin at one extremity of the slotted hole when there is no external constraint as in the case of a fully closed or fully open swinging door fitted flush to the front face of the door frame. When the swinging door is pulled open or pushed shut, the edge of the door adjacent to the hinge interferes with the door frame and the hinge pin is forced to shift toward the other extremity of the slotted hole against the spring bias; whereby, the interference between the door edge adjacent to the hinge and the door frame is alleviated for the full range of the swing for the swinging door.

1 Claim, 25 Drawing Figures

10 5 1 8

SPRING BIASED SHIFTING PIVOTING CENTER HINGE

BACKGROUND OF THE INVENTION

There are serious demands in the home and office furniture industry for a strong and inexpensive hinge for swinging doors which can be easily installed in a concealed configuration. Such hinges should be usable with the swinging doors disposed flush to one or both side faces of the door frame, which swings open in either of two opposite directions. Such hinges should not be visible once they are installed whether the swinging door is fully closed, or fully open or partially open. At the present time, there is no such hinge that has all of the aforementioned features.

The primary object of the present invention is to provide a hinge for swinging doors that enables them to fit a single or a pair of swinging doors flush to one or both side faces of the door frame wherein the swinging doors can be swung open in either of two directions.

Another object of the present invention is to provide the door hinges disposed at the coners of the swinging door wherein the door hinges are concealed for all instances no matter if either the swinging doors are fully closed or fully or partially open.

A further object of the present invention is to provide a door hinge with a spring bias means that automatically retains the swinging door at the fully closed position.

Still another object of the present invention is to provide a door hinge wherein the hinge pin rigidly affixed to the first swinging half of the door hinge engages rotatably and shiftably a slotted hole disposed in the second swinging half of the hinge.

Still a further object of the present invention is to provide a door hinge including a spring bias means that retains the hinge pin at one extremity of the slotted hole rotatably and shiftably engaged by the hinge pin.

Yet another object of the present invention is to provide a door hinge made essentially of a sheet metals and metal wires or rods.

Yet a further object of the present invention is to provide a door hinge with the hinge pin rotatably and shiftably engaging a hole of a substantially triangular cross section wherein spring bias means retain the hinge pin at one of three corners in said hole when an external counter-acting force is absent.

These and other objects of the present invention will become clear as the description thereof proceeds.

SPECIFICATION OF THE INVENTION

The present invention may be described with great clarity and specificity by referring to the following Figures.

Figure 1:
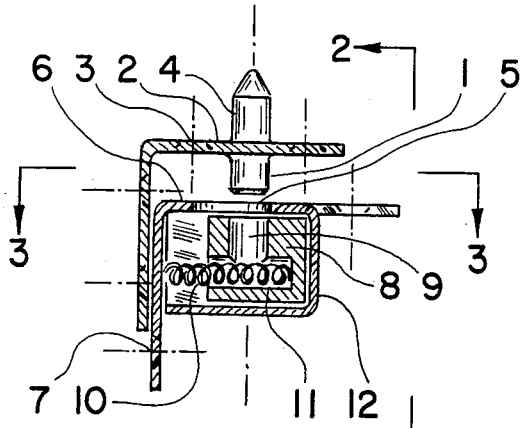
FIG. 1 illustrates a cross section of a spring biased shifting pivoting center hinge taken along a plane including the pivoting axis of the hinge.

In FIG. 1 there is shown a cross section of a spring biased shifting pivoting center hinge constructed in accordance with the principles of the present invention, which cross section is taken along a plane including the pivoting axis of the hinge. The first half of the hinge comprises the hinge pin 1 rigidly affixed to the first fastening means 2, which is an angled sheet metal with a plurality of the counter sunk screw holes 3. The hinge pin 1 engages and extends through a hole disposed through the fastening means 2 wherein the former is welded to the latter. The extruding extremity 4 of the hinge pin 1 is to engage a hole drilled into the door frame, while the angled sheet metal of the fastening means 2 is designed to mount the hinge pin assembly to a corner of the door frame. Of course, the hinge pin 1 may be terminated flush to the top of the fastening means 2 when an extra anchoring strength requiring the extruding portion of the hinge pin is not needed. The second half of the hinge comprises a slotted hole 5 disposed through a sheet metal of the second fastening means 6, which second fastening means is an angled sheet metal including a plurality of the counter-sunk screw holes 7. A sliding block 8 including a circular hole 9 rotatably receiving the hinge pin 1 is slidably disposed beneath the portion of the sheet metal including the slotted hole 5 in such a way that the circular hole 9 included in the sliding block 8 remains lined up with the slotted hole 5 while the sliding block 8 is moved in a direction parallel to the major axis of the slotted hole 5. The coil spring 10 engaging a hole 11 disposed in the sliding block 8 perpendicular to the circular hole 9 provides a spring bias means that keeps the hinge pin 1 engaging the circular hole 9 at one extremity of the slotted hole 5 when an external counteracting force is absent. The block 8 is slidably confined in an enclosure 12 affixed to the fastening means 6 wherein the sliding block 8 is slidable in a direction parallel to the major axis of the slotted hole 5. It should be understood that in assembled structure, the hinge pin 1 extending through the slotted hole 5 rotatably engages the circular hole 9 wherein first fastening means 2 is in full contact with the second fastening means 6.

Figure 2:
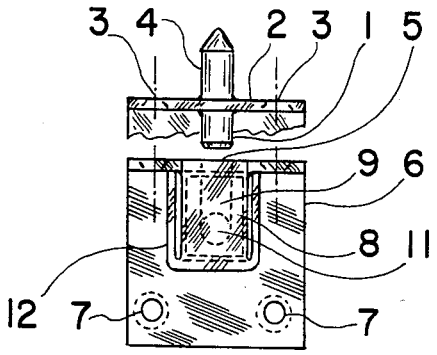
FIG. 2 illustrates another cross section of the door hinge shown in FIG. 1 taken along a plane 2—2 as shown in FIG. 1.

In FIG. 2, there is shown another cross section of the door hinge shown in FIG. 1 taken along a plane 2—2 as shown in FIG. 1. It is noticed that the enclosure 12 slidably enclosing the sliding member 8 is formed of a sheet metal that is an extension of the fastening means 6.

Figure 3:
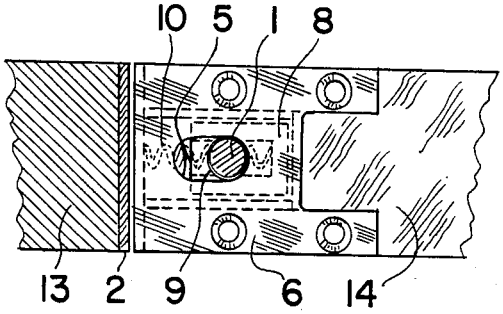
FIG. 3 illustrates a further cross section of the door hinge shown in FIG. 1 taken along a plane 3—3 as shown in FIG. 1.

In FIG. 3, there is shown a further cross section of the door hinge shown in FIG. 1 taken along a plane 3—3 as shown in FIG. 1. In this FIGURE, the fastening means 2 is affixed to the inside corner of a door frame 13 and the fastening means 6 is affixed to the outside corner of the door 14.

Figure 4:
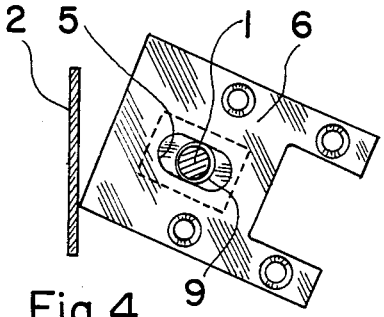
FIG. 4 illustrates the same cross section of the door hinge of FIG. 1 as that shown in FIG. 3, wherein the door is now partially opened.
Figure 5:
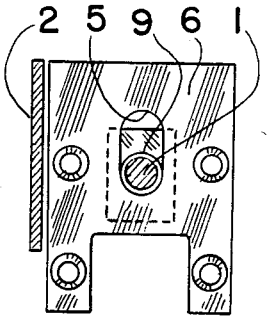
FIG. 5 illustrates the same cross section of the door hinge of FIG. 1 as that shown in FIG. 3 wherein the door is now fully opened.

The working principles of the door hinge shown in FIG. 1 will be explained in conjunction with FIGS. 3, 4 and 5. Two hinges respectively installed at two corners of a swinging door 14 assembled to fit inside of the door frame 13 enables it to close and open a swinging door that is assembled flush to the front face of the door frame. In this embodiment, the first half of the hinge including the hinge pin 1 is affixed to the door frame adjacent to one of its inside corners and the second half of the hinge including the spring biased sliding member 8 is installed on the swinging door at one of its outside corners with a pocket designed to accept the enclosure 12. When the swinging door is at the fully closed position as shown in FIG. 3, the coil spring 10 pushes the door against the inside face of the door frame and keeps it at the fully closed position automatically. When the door is partially swung open as shown in FIG. 4, the pressure on the edge of the door frame shifts the door away from the inside face of the door frame which shifting movement clears off the interference between the edge of the door and the inside face of the door and, consequently, the door is allowed to swing open to the fully open position as shown in FIG. 5. It is readily noticable that, when the door is left open at a partially open position as shown in FIG. 4, it will either close to the fully closed position as shown in FIG. 3, or open to the fully open position as shown in FIG. 5 due to the spring bias effect of the coil spring 10. It should be understood that, in order to be able to initiate an easy closing movement from the fully open position, the hinge should be designed in such a way that there is a gap between the inside face of the door frame and the front side of the door positioned at the fully open position as shown in FIG. 5. It should be further understood that the angled leg portions of the fastening means 2 and 6 respectively connected to the other portions including the hinge pin 1 and the slotted hole 5, respectively, are included to provide the bearing surfaces which rub one another during opening and closing of the door. Of course, the doors and frames with built in hard surfaces such as the metalic doors and frames, will not require the aforementioned angled leg portions of the fastening means 2 and 6.

Figure 6:
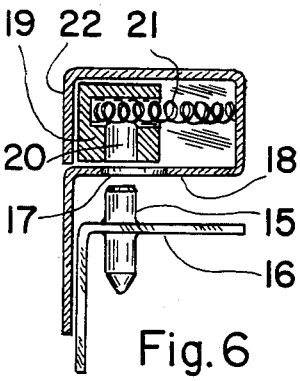
FIG. 6 illustrates a cross section of another door hinge operating on the same principle as that of FIG. 1.

In FIG. 6, there is shown a cross section of another spring biased shifting pivoting center hinge taken along a plane including the pivoting axis of the hinge. The hinge pin 15 is affixed to the second fastening means 16 to be affixed to the outer corner of the swinging door, while the slotted hole 17 is disposed through the first fastening means 18 which includes the sliding block 19 with the circular hole 20 and the coil spring 21 keeping the circular hole 20 lined up with the other extremity of the slotted hole 17 wherein said other extremity is the extremity opposite to said one extremity defined in conjunction with FIG. 1. In this embodiment the hinge pin 15 is affixed to the door, while the enclosure 22 slidably containing the slide block is affixed in a pocket formed in the door frame. This door hinge works in the same principle as that of FIG. 1.

Figure 7:
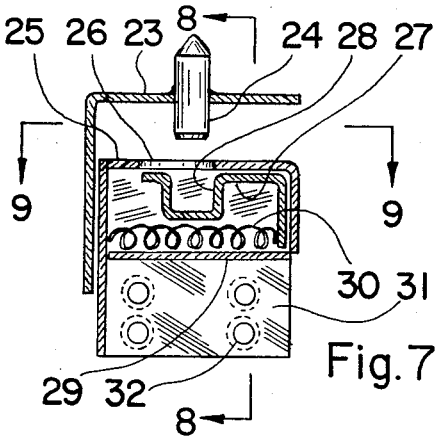
FIG. 7 illustrates a cross section of a light duty door hinge taken along a plane including the pivoting axis of the door hinge.

In FIG. 7, there is shown a cross section of a spring biased shifting pivoting center hinge of all sheet metal construction usable for reasonably thin doors which do not have a sufficient thickness to provide a pocket for the hidden installation of the hinge such as that of FIG. 1. The first fastening means 23 supporting the hinge pin 24 has the same construction as the corresponding part of the hinge shown in FIG. 1. The second fastening means 25 including the slotted hole 26 has a sliding member 27 with a receiving means 28 rotatably receiving the hinge pin 24, which sliding member is slidably contained in an enclosure 29 affixed to the second fastening means 25 and spring biased by the coil spring 30 that keeps the receiving means 28 lined up with one extremity of the slotted hole 26. It should be noticed that the sliding member 27 can be easily formed from a strip of sheet metal and that the enclosure 29 also contains the coil spring 30. The fastening means 31 including a plurality of the counter-sunk screw holes 32 is disposed in such a way that it can be fastened to the rear surface of the swinging door with a pocket disposed on the rear side of the door to receive the enclosure 29.

Figure 8:
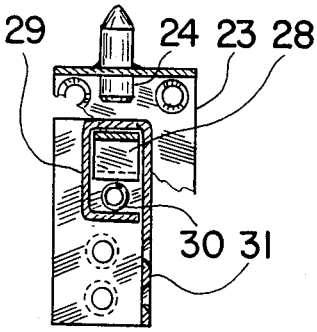
FIG. 8 illustrates another cross section of the door hinge of FIG. 7 taken along a plane 8—8 as shown in FIG. 7.

In FIG. 8, there is illustrated another cross section of the door hinge shown in FIG. 7 taken along a plane 8—8 as shown in FIG. 7.

Figure 9:
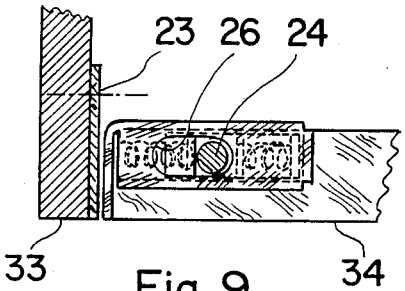
FIG. 9 illustrates a further cross section of the door hinge of FIG. 7 taken along a plane 9—9 as shown in FIG. 7.

In FIG. 9, there is illustrated a further cross section of the door hinge shown in FIG. 9 taken along a plane 9—9 as shown in FIG. 7, wherein the door frame 33 and the door 34 are also shown. The door hinge illustrated in FIG. 7, 8 and 9 works in the same way as that shown in FIG. 1.

Figure 10:
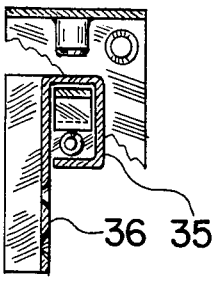
FIG. 10 illustrates a cross section of another light duty door hinge.

In FIG. 10, there is shown a modified version of the door hinge shown in FIG. 8, which version is designed for very thin doors. The enclosure 35 housing the sliding member and the coil spring is disposed on the back side of the fastening means 36 instead of the front side as shown in FIG. 8; whereby, it is not required that the door structure provides a pocket to accept the enclosure 35.

Figure 11:
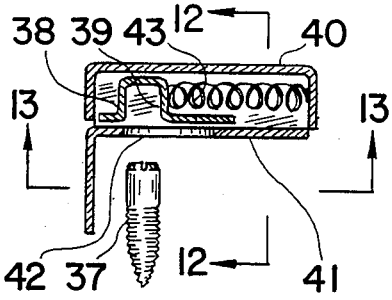
FIG. 11 illustrates a cross section of a further light duty door hinge taken along a plane including the pivoting axis of the door hinge.

In FIG. 11, there is illustrated a cross section of another door hinge of all sheet metal construction wherein the hinge pin 37 is fastened to the door by screw means and the sliding member 36 with the receiving means 39 is slidably enclosed in an enclosure 40 affixed to the fastening means 41 with the slotted hole 42, which combination is fastened to the door frame. Of course, the door frame must be provided with a pocket to accept the enclosure 40. The coil spring 43 contained in the enclosure 40 provides a spring bias force that keeps the receiving means 39 lined up with the other extremity of the slotted hole 42.

Figure 12:
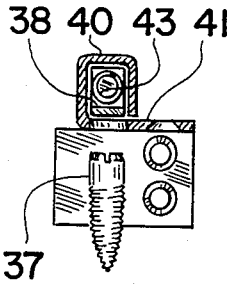
FIG. 12 illustrates another cross section of the door hinge of FIG. 11 taken along a plane 12—12 as shown in FIG. 11.

In FIG. 12, there is illustrated another cross section of the door hinge shown in FIG. 11 taken along a plane 12—12 as shown in FIG. 11.

Figure 13:
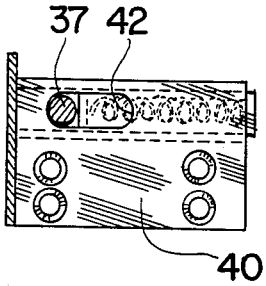
FIG. 13 illustrates a further cross section of the door hinge shown in FIG. 11 taken along a plane 13—13 as shown in FIG. 11.

In FIG. 13, there is illustrated a further cross section of the door hinge shown in FIG. 13 taken along a plane 13—13 as shown in FIG. 11.

Figure 14:
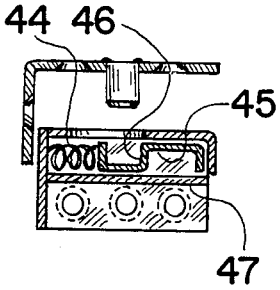
FIG. 14 illustrates a cross section of a door hinge similar to that shown in FIG. 7.

In FIG. 14, there is illustrated a cross section of a door hinge having essentially the same construction as that shown in FIG. 7 with an exception: A coil spring 44 of a shorter length is installed in line with the sliding member 45 with the receiving means 46 in the enclosure 47, which combination results in a more compact hinge assembly compared with that shown in FIG. 7.

Figure 15:
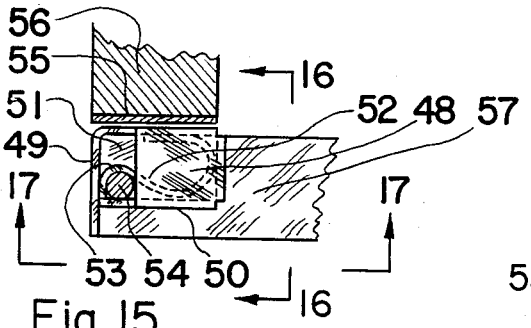
FIG. 15 illustrates a cross section of still another door hinge taken along a plane perpendicular to the pivoting axis of the door hinge.

In FIG. 15, there is illustrated a cross section of a spring biased shifting pivoting center hinge constructed in accordance with the principles of the present invention, which cross section is taken along a plane perpendicular to the pivoting axis of the hinge. This hinge is for installing a swinging door off-set from the front face of the door frame. The first half 48 of the hinge including the fastening means 49 and the enclosure 50 has a slotted hole or opening 51. A leaf spring 52 with a receiving means 53 formed at one extremity of said leaf spring is enclosed within the enclosure 50 wherein the receiving means 53 rotatably receives the hinge pin 54 rigidly affixed to the fastening means 55, which hinge pin engaging and extending through the slotted hole 51. The spring bias force created by the leaf spring 52 keeps the hinge pin 54 engaging the receiving means 53 at one extremity of the slotted hole 51. It is noticed that the hinge pin half of the hinge is affixed to the door frame 56 and the pivoting half 48 including the slotted hole 51 and the receiving means is affixed to the door 57.

Figure 16:
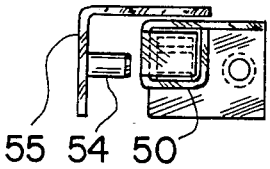
FIG. 16 illustrates another cross section of the door hinge of FIG. 15 taken along a plane 16—16 as shown in FIG. 15.

In FIG. 16, there is shown another cross section of the door hinge shown in FIG. 15 taken along a plane 16—16 as shown in FIG. 15.

Figure 17:
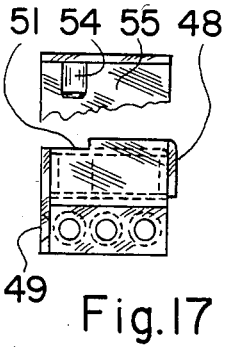
FIG. 17 illustrates a further cross section of the door hinge shown in FIG. 15 taken along a plane 17—17 as shown in FIG. 15.

In FIG. 17, there is shown a further cross section of the door hinge shown in FIG. 15 taken along a plane 17—17 as shown in FIG. 15.

Figure 18:
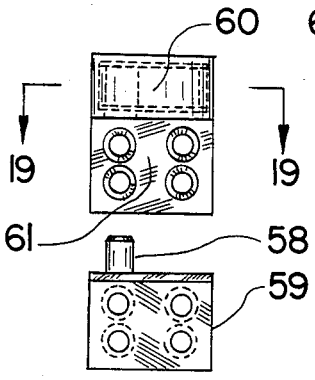
FIG. 18 illustrates a perspective view of a still further door hinge.

In FIG. 18, there is illustrated a door hinge including the hinge pin 58 affixed to the fastening means 59 to be fastened to the door and the spring biased receiving means housed in an enclosure 60 affixed to the fastening means 61 to be fastened to the front face of the door frame.

Figure 19:
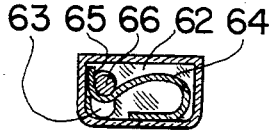
FIG. 19 illustrates a cross section of the door hinge shown in FIG. 18 taken along a plane 19—19 as shown in FIG. 18.

In FIG. 19, there is illustrated a cross section of the door hinge shown in FIG. 18 taken along a plane 19—19 as shown in FIG. 18. The wall 62 of the enclosure 60 adjacent and perpendicular to the fastening means 61 includes a slotted hole 63. The leaf spring 64 contained in the enclosure 60 has receiving means 65 that rotatably receives the hinge pin 66 extending through the slotted hole 63. The spring bias force of the leaf spring 64 keeps the hinge pin 66 rotatably engaging the receiving means 65 at the other extremity of the slotted hole 63.

Figure 20:
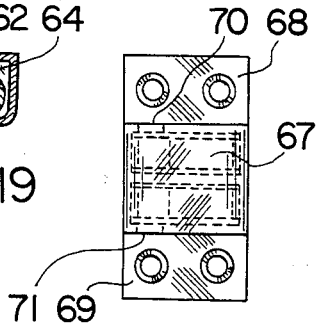
FIG. 20 illustrates a modified version of an element employed in the door hinge shown in FIG. 18.

In FIG. 20, there is illustrated an enclosure 67 with double fastening means 68 and 69 that has two slotted holes 70 and 71 lined up with a pair of receiving means provided by a pair of the leaf springs of the same construction as that shown in FIG. 19 and contained in the enclosure 67. This receiving half of the hinge is for receiving a pair of the hinge pin of the construction similar to that shown in FIG. 18.

Figure 21:
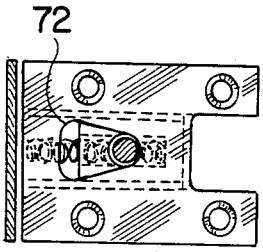
FIG. 21 illustrates a modified version of the door hinge shown in FIG. 3.

In FIG. 21, there is illustrated a modification of the hinge shown in FIG. 3 wherein the slotted hole is now modified to a triangular shaped hole 72 that enables one to initiate the closing movement of the door without requiring the gap between the inside face of the door frame and the front face of the door as shown in FIG. 5.

Figure 22:
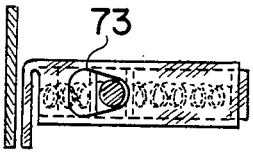
FIG. 22 illustrates a modified version of the door hinge shown in FIG. 9.

In FIG. 22, there is illustrated a modification of the door hinge shown in FIG. 9 wherein the slotted hole is now modified to a triangular shaped hole 73 for the same object as mentioned in conjunction with FIG. 21.

Figure 23:
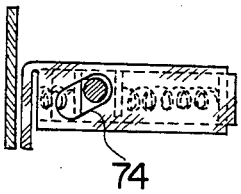
FIG. 23 illustrates another modified version of the door hinge shown in FIG. 9.

In FIG. 23, there is illustrated another modification of the door hinge shown in FIG. 9 wherein the slotted hole lined up with the face of the door is now modified to a slotted hole 74 slanted with respect to the face of the door, which modification is made for the aforementioned object.

Figure 24:
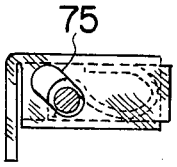
FIG. 24 illustrates a modified version of the door hinge shown in FIG. 15.

In FIG. 24, there is shown a modification of the door hinge shown in FIG. 15 wherein the slotted hole disposed perpendicular to the face of the door is now modified to a slotted hole 75 slanted with respect to the face of the door.

Figure 25:
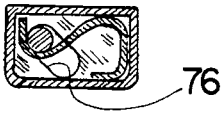
FIG. 25 illustrates a modified version of the door hinge shown in FIG. 19.

In FIG. 25, there is shown a modification of the door hinge shown in FIG. 19 wherein the slotted hole disposed perpendicular to the face of the door is now modified to a slotted hole 76 slanted with respect to the face of the door which is done for the aforementioned object. While the principles of the present invention have now been made clear by the illustrative embodiments, there will be immediately obvious to those skilled in the art many modifications in the structures, elements, proportions, materials and arrangement which are particularly adapted to the specific working environment and operating condition in the practice of the invention without departing from the principles of the present invention.

We claim:

1. A spring biased shifting pivoting center hinge comprising: a hinge pin rigidly affixed to an angled piece of sheet metal, said piece of sheet metal having a first fastening means, said first fastening means comprising a plurality of counter sunk screw holes, said hinge pin extending through and engaging a hole disposed in said angled piece of sheet metal so as to be located on both sides of said sheet metal, said hinge pin being welded to the angled piece of sheet metal, a one piece sheet metal enclosure including a second fastening means, said second fastening means comprising a plurality of counter sunk holes, said sheet metal enclosure having a substantially triangular shaped slotted hole disposed through a top wall of said sheet metal enclosure, a sliding block having a vertically oriented circular hole and a horizontal oriented hole and being slidably disposed beneath the top wall of the sheet metal enclosure in directions substantially parallel to one center line of said substantially triangular hole, said circular hole rotatably receiving said hinge pin that extends through and engages said substantially triangular hole, a coil spring resiliently retaining said sliding member at one extremity of its sliding position wherein said hinge pin is substantially located at one corner of said substantially triangular hole, said coil spring being received in and engaging at one end the horizontally oriented hole in said sliding block and engaging at another end the sheet metal enclosure, said sliding block being slidably confined on all sides by bent sections of said one piece sheet metal enclosure.

* * * * *